US011919687B2

(12) United States Patent
Brozell et al.

(10) Patent No.: US 11,919,687 B2
(45) Date of Patent: Mar. 5, 2024

(54) PACKAGE, CONTAINER, CLOSURE ASSEMBLY, AND CLOSURE COMPONENTS

(71) Applicant: Owens-Brockway Glass Container Inc., Perrysburg, OH (US)

(72) Inventors: Brian Brozell, Maumee, OH (US); Thomas Shepherd, Lambertville, MI (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

(21) Appl. No.: 17/537,796

(22) Filed: Nov. 30, 2021

(65) Prior Publication Data

US 2023/0166893 A1 Jun. 1, 2023

(51) Int. Cl.
*B65D 51/18* (2006.01)
*B65D 1/02* (2006.01)

(52) U.S. Cl.
CPC ..... *B65D 51/18* (2013.01); *B65D 1/0246* (2013.01); *B65D 2251/0015* (2013.01); *B65D 2251/0093* (2013.01)

(58) Field of Classification Search
CPC ..... B65D 51/18; B65D 1/0246; B65D 2251/0015; B65D 2251/0093
USPC ..... 215/43; 220/256.1, 259.3, 259.4
See application file for complete search history.

(56) References Cited

U.S. PATENT DOCUMENTS 3,704,819 A * 12/1972 Lindstrom ..... B65D 51/18 222/546
4,192,428 A * 3/1980 Segmuller ..... B65D 51/18 215/354
4,487,325 A * 12/1984 Willingham ..... B65D 41/0435 215/350
5,316,163 A * 5/1994 von Schuckmann ..... B65D 51/002 215/277

(Continued)

FOREIGN PATENT DOCUMENTS

EP 0427688 5/1991
EP 1342671 A2 * 9/2003 ..... B65D 41/0421

(Continued)

OTHER PUBLICATIONS

PCT Int. Search Report and Written Opinion, Int. Serial No. PCT/US2022/051357, Int. Filing Date: Nov. 30, 2022, Applicant: Owens-Brockway Glass Container Inc., Dated: Apr. 6, 2023.

*Primary Examiner* — J. Gregory Pickett
*Assistant Examiner* — Niki M Eloshway

(57) ABSTRACT

Disclosed are configurations of inner and outer shells for a multi-piece closure assembly. The inner shell includes a base wall, and an outer skirt extending away from the base wall, carrying external thread segments, and including an axially outward portion, and an axially inward portion terminating in a grip petal portion having petals with radially inwardly projecting container engagement lugs and radially outwardly projecting outer shell engagement lugs. The outer shell includes a base wall, an inner skirt extending away (Continued)

from the base wall, and an outer skirt extending away from an outer periphery of the base wall at a location spaced radially outwardly from the inner skirt and including an internally threaded portion carrying internal thread segments and an unthreaded extension extending away from the threaded portion and on an axial side of the internally threaded portion opposite that of the base wall.

16 Claims, 9 Drawing Sheets

(56) References Cited

U.S. PATENT DOCUMENTS 5,803,286 A 9/1998 Pfefferkorn et al.
5,960,972 A * 10/1999 Larguia, Sr. ..... B65D 41/18 215/322
9,051,074 B2 6/2015 Lonsway et al.
2006/0231519 A1* 10/2006 Py ..... B65D 51/18 220/259.3
2011/0000872 A1* 1/2011 Aneas ..... B65D 45/322 215/273
2013/0146600 A1* 6/2013 Krikor ..... B65D 51/244 220/359.3
2014/0103043 A1* 4/2014 Lonsway ..... B65D 41/34 220/255
2019/0315526 A1* 10/2019 Gómez Cao ..... B65D 50/06
2021/0171249 A1* 6/2021 Aboabdo ..... B65D 41/0485

FOREIGN PATENT DOCUMENTS

LU 33480 A1 5/1955
WO WO84/01763 5/1984
WO WO-03059767 A1 * 7/2003 ..... B65D 41/3447
WO 2006000779 A2 1/2006

* cited by examiner

PACKAGE, CONTAINER, CLOSURE ASSEMBLY, AND CLOSURE COMPONENTS

TECHNICAL FIELD

This patent application discloses innovations to packages and, more particularly, to containers, closure assemblies, and closure components.

BACKGROUND

Container closures include crimpable closures, for example, securable to crown finishes of bottles. U.S. Pat. No. 3,494,093 illustrates an example crimp-type closure. Container closures also include threadable closures, for example, securable to threaded finishes of bottles. U.S. Pat. Nos. 2,789,719 and 4,337,678 illustrate examples of thread-type closures. Container closures further include resealable multi-shell closure assemblies, for example, securable to beaded neck finishes of bottles. U.S. Pat. No. 9,051,074 illustrates an example of this type of resealable multi-shell closure assembly. Although such closure assemblies may be commercially acceptable, some closure assembly designs require a container to have closure circumferential orientation features and involve complex closure shell retention configurations.

SUMMARY OF THE DISCLOSURE

The present disclosure embodies a number of aspects that can be implemented separately from or in combination with each other.

A multi-piece container closure assembly in accordance with one aspect of the disclosure includes an outer shell coupled to an inner closure, which includes an inner shell and a plug liner coupled to the inner shell. The inner shell includes a base wall, and an outer skirt extending away from an outer periphery of the base wall and carrying external thread segments. The outer skirt includes an axially outward portion extending in a direction axially outwardly away from the base wall, and an axially inward portion extending in a direction axially inwardly away from the base wall and terminating in a grip petal portion having a plurality of circumferentially spaced petals with radially inwardly projecting container engagement lugs and radially outwardly projecting outer shell engagement lugs. The outer shell includes a base wall, an inner skirt extending away from the base wall, and an outer skirt extending away from an outer periphery of the base wall at a location spaced radially outwardly from the inner skirt. The outer skirt includes an internally threaded portion carrying internal thread segments and an unthreaded extension extending away from the threaded portion and on an axial side of the internally threaded portion opposite that of the base wall.

In accordance with another aspect of the disclosure, there is provided a package, including the aforementioned closure assembly applied to a bottle having a beaded neck finish with an open mouth and a bead with an undersurface. The container engagement lugs of the inner closure axially align with the undersurface of the bead of the beaded neck finish of the bottle and the plug liner seals the open mouth of the beaded neck finish. The unthreaded extension of the outer shell engages the petals of the inner closure to force the petals into locking engagement with the undersurface of the bead of the beaded neck finish.

In accordance with a further aspect of the disclosure, there is provided an inner closure including an inner shell and a plug liner molded to the inner shell. The inner shell includes a base wall, and an outer skirt extending away from an outer periphery of the base wall, and carrying external thread segments. The outer skirt includes an axially outward portion extending in a direction away from the base wall, and an axially inward portion extending in a direction away from the base wall and terminating in an axially inward grip petal portion having a plurality of circumferentially spaced petals with radially inwardly projecting container engagement lugs and radially outwardly projecting outer shell engagement lugs.

In accordance with an additional aspect of the disclosure, there is provided an outer shell for a multi-piece container closure assembly. The outer shell includes a radially continuous base wall, and an outer skirt extending away from an outer periphery of the base wall and including an internally threaded portion including thread segments, and an unthreaded extension extending away from the threaded portion and on an axial side of the internally threaded portion opposite that of the base wall. The outer shell also includes an inner skirt extending away from the base wall at a location spaced radially inwardly from the outer skirt, and carrying ramped stop lugs projecting in a radially outward direction.

DETAILED DESCRIPTION

In contrast to prior multi-piece closure assemblies, the presently disclosed subject matter does not require a container to have closure circumferential orientation features and does not involve complex closure shell retention configurations. To the contrary, the presently disclosed closure assembly and components allow use of a container having a beaded neck finish that is circumferentially continuous, and includes a closure shell retention configuration that relies on partially engaged thread segments and stop lugs, as will be described in detail below.

Figure 1:
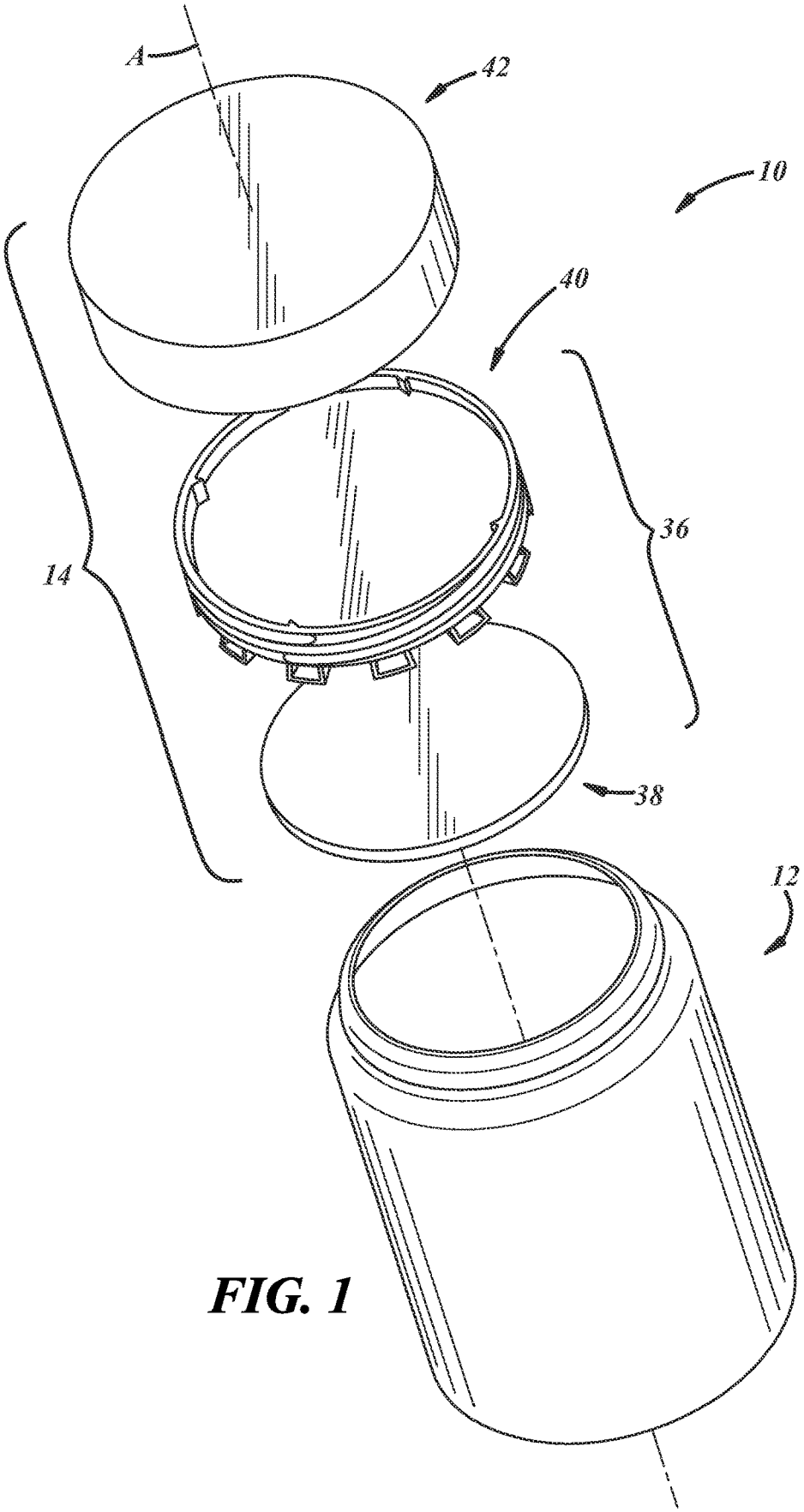
FIG. 1 is an exploded perspective view of a package in accordance with an illustrative embodiment of the present disclosure, and including illustrative embodiments of a container and a closure assembly.

With specific reference to the drawing figures, FIG. 1 shows an illustrative embodiment of a package 10 including a container 12, and a closure 14 configured to be coupled to the container 12. The package 10 includes a longitudinal axis A along which the container 12 generally longitudinally extends, and along which the closure 14 may be applied to and removed from the container 12, and about which a portion of the closure 14 may be rotated. In one embodiment, the package 10 may include a beverage package, and may be used to contain pressurized liquid, for example, carbonated beverages, like beer, soda, etc. Accordingly, the package 10 may be a closed beer bottle, closed soda bottle, or the like. In other embodiments, the package 10 may include any other suitable type of closed container for any suitable purpose. As used herein, directional words such as top, bottom, upper, upward, downward, lower, radial, circumferential, lateral, longitudinal, transverse, vertical, horizontal, and the like are employed by way of description and not necessarily limitation.

Figure 2:
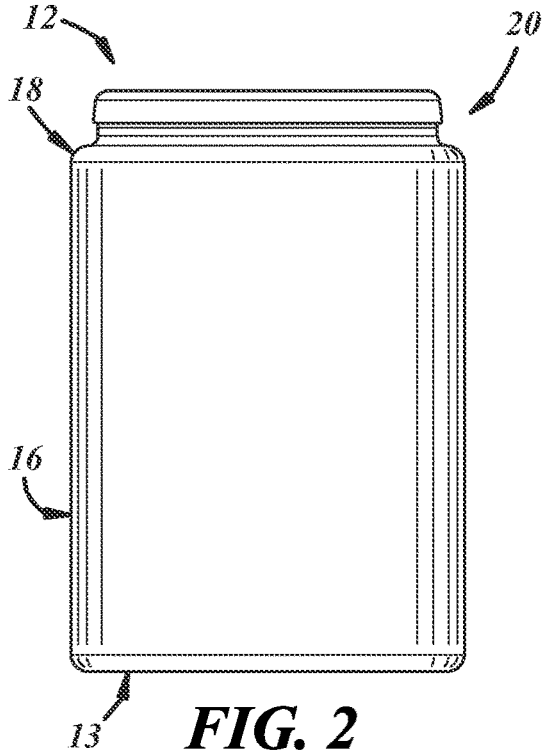
FIG. 2 is an elevational view of an illustrative embodiment of the container of the package of FIG. 1.
Figure 3:
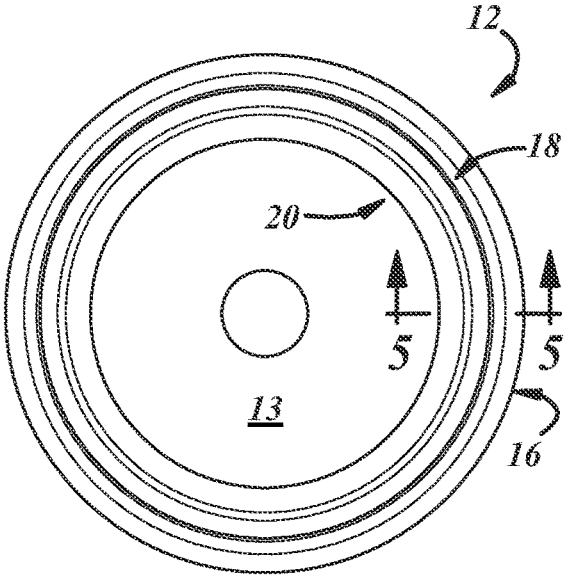
FIG. 3 is an enlarged top view of the container of FIG. 2.
Figure 4:
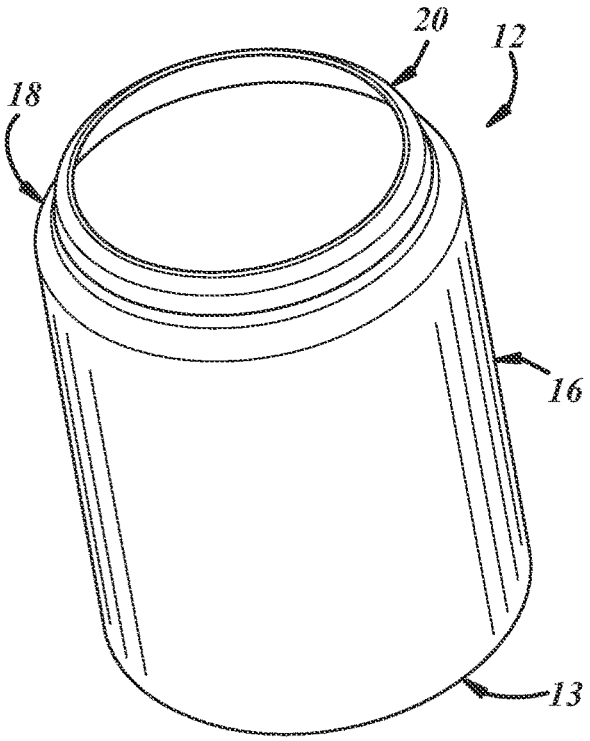
FIG. 4 is an upper perspective view of the container of FIG. 2.

With reference to FIGS. 2 through 4, the container 12 may be of one-piece integrally formed construction, preferably glass, plastic, or metal construction. The container 12 may be fabricated in press-and-blow or blow-and-blow glass container manufacturing operations, in a plastic injection and/or blow molding operation, in a metal drawing operation, or in any other suitable manner. The container 12 includes a base 13 on which the container 12 may be supported, a body 16 extending axially outwardly from the base 13, a shoulder 18 extending radially inwardly and axially outwardly from the body 16, and a neck 20 extending axially outwardly away from the shoulder 18. As used herein, the term "axial" includes oriented generally along a longitudinal axis of the closure 14, container 12, or package 10, and may include but is not limited to a direction that is strictly parallel to such axis.

Figure 5:
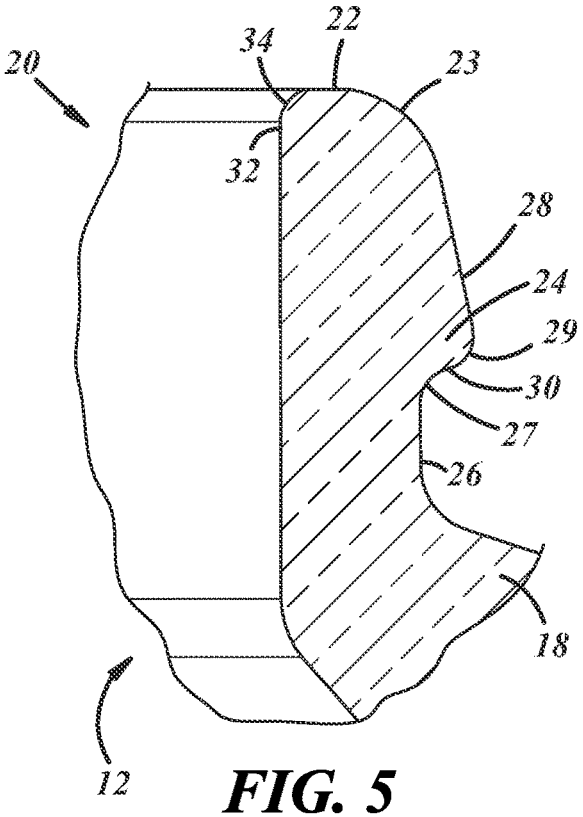
FIG. 5 is an enlarged cross-sectional view of a portion of the container of FIG. 2, taken along line 5-5 of FIG. 3.
Figure 6:
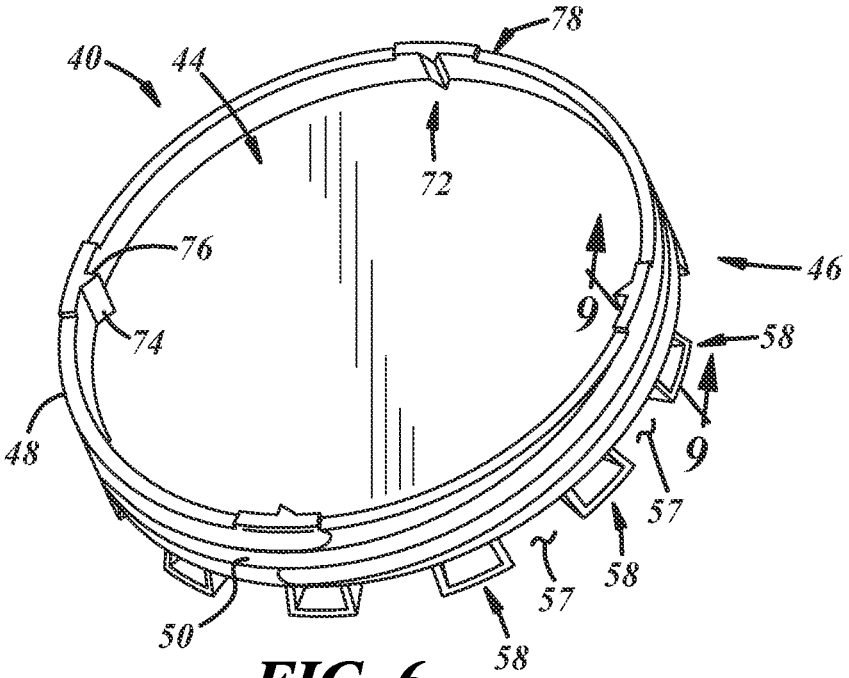
FIG. 6 is an upper perspective view of an illustrative embodiment of an inner shell of an inner closure of the closure assembly of FIG. 1.
Figure 7:
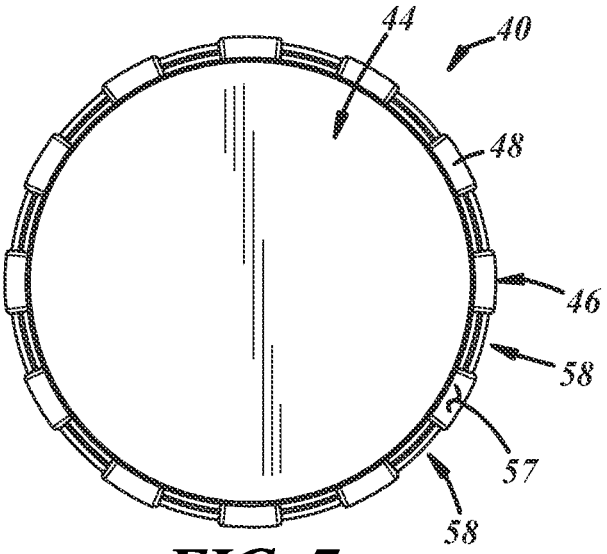
FIG. 7 is a diminished bottom view of the inner shell of FIG. 6.

With reference to FIG. 5, the neck 20 of the container 12 includes an axial outwardly facing surface or lip 22, an outer annular bead 24 axially between the shoulder 18 and the lip 22, and an outer annular reduced diameter portion or relief 26 between the bead 24 and the shoulder 18. The bead 24 is circumferentially continuous, without any closure circumferential locating features, and includes a radially and axially outwardly facing surface or flank 28, and a radially outwardly and axially inwardly facing undersurface or shoulder 30. The bead 24 further may include a transition surface 23, which may be rounded or excurvate, between the lip 22 and the flank 28 of the bead 24. The bead 24 additionally may include a fillet 27 between the shoulder 30 and the relief 26, and a round 29 between the shoulder 30 and the flank 28. The neck 20 also may include an inner annular sealing surface or mouth 32, which may be axially spaced from the lip 22 by an internal excurvate surface or round 34, and which may be cylindrical.

With reference again to FIG. 1, the closure 14 is a multi-piece closure assembly and, in particular, may be a two-shell closure, for example, including only two closure shells. The closure 14 includes an inner closure 36 including a plug liner 38 and an inner shell 40 to carry the plug liner 38, and a cap or outer shell 42 configured to be coupled to the inner shell 40. The inner shell 40 is configured to be secured directly to the container 12 and to sealingly engage directly with the container 12. In contrast, the outer shell 42 is configured to be secured directly to the inner shell 40 but indirectly to the container 12. The inner and outer shells 40, 42 may be composed of polymeric material, or any other material suitable for use with, for instance, food or beverage packaging, and may be injection molded, compression molded, or produced in any other suitable manner.

With reference to FIGS. 6 through 9, the inner shell 40 may be composed of a polymeric material, and includes an inner shell base wall 44 extending transversely with respect to the axis A (FIG. 1), and an annular outer skirt 46 extending axially from a radially outer periphery of the base wall 44, and including a radially outer surface 48 and one or more external thread segments 50 projecting from the outer surface 48. As used herein, the term "transverse" means disposed at some oblique angle with respect to a longitudinal axis of the closure, container, or package and along any direction intersecting the closure, container, or package, and may include but is not limited to a radial direction. In the illustrated embodiment, the inner shell 40 includes four thread segments 50 and four thread starts. As used herein, the phrase "thread segment" includes whole, partial, multiple, and/or an interrupted thread and/or thread segment.

Figure 8:
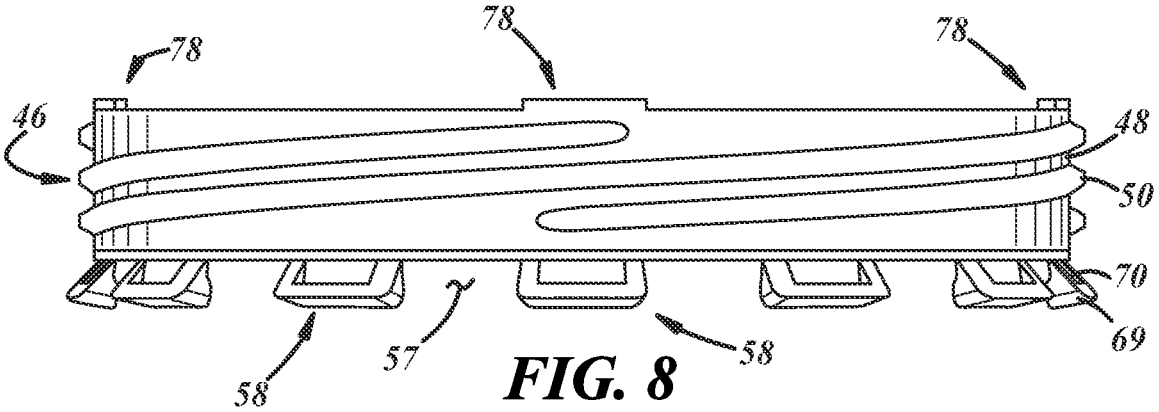
FIG. 8 is an enlarged elevational view of the inner shell of FIG. 6.
Figure 9:
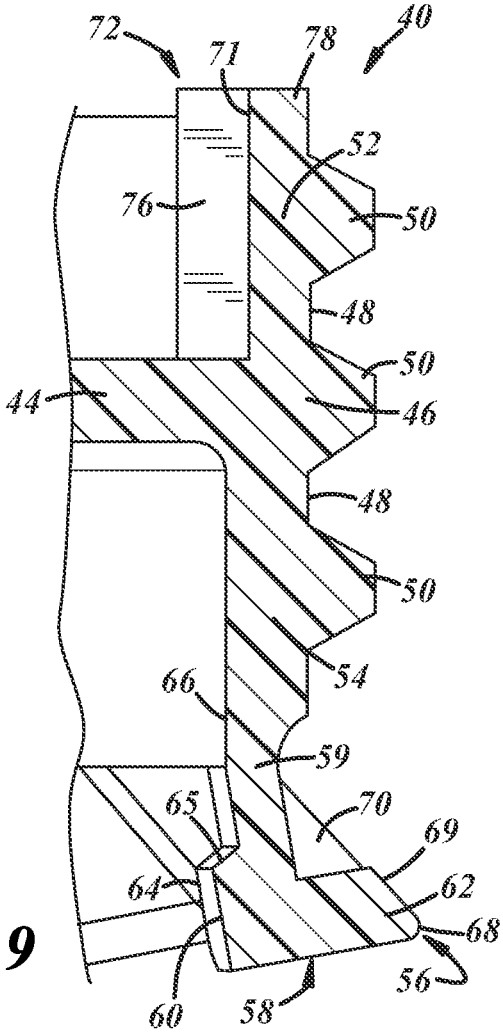
FIG. 9 is an enlarged cross-sectional view of a portion of the inner shell of FIG. 6, taken along line 9-9 of FIG. 6.
Figure 12:
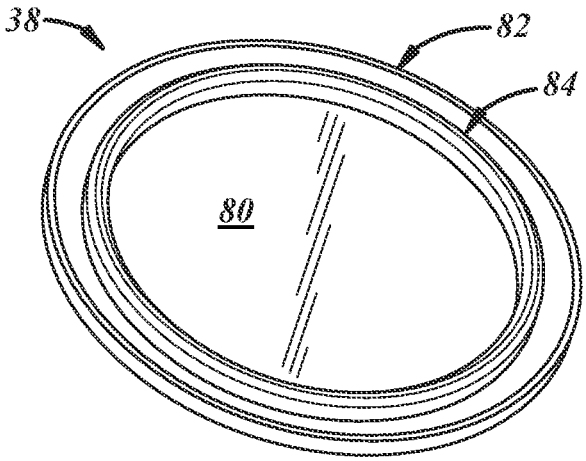
FIG. 12 is a lower perspective view of an illustrative embodiment of a plug liner of the inner closure of the closure assembly of FIG. 1.
Figure 13:
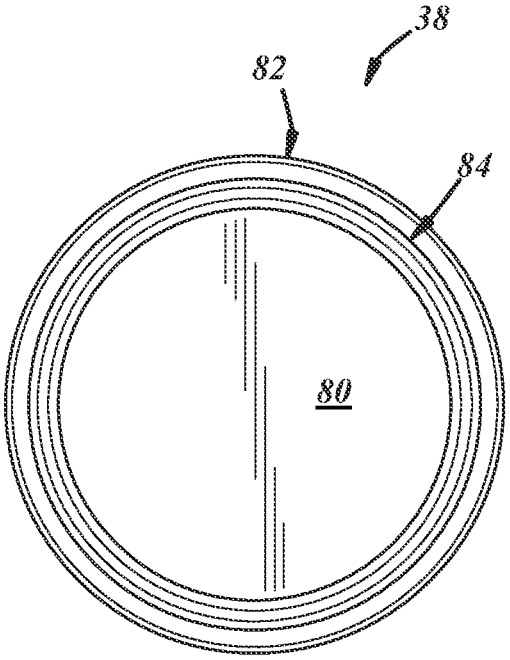
FIG. 13 is a bottom view of the plug liner of FIG. 12.
Figure 14:
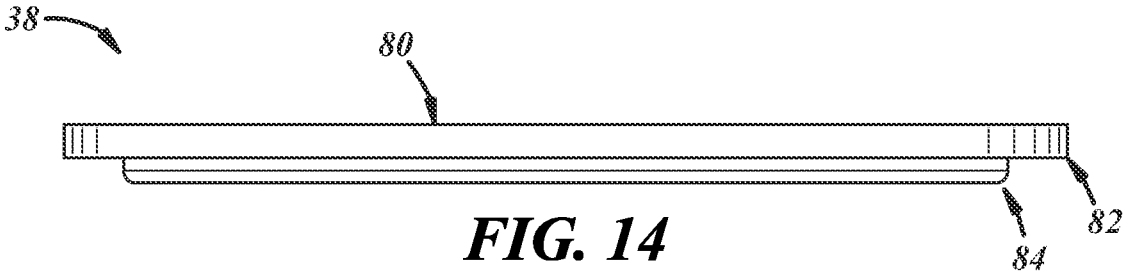
FIG. 14 is an enlarged elevational view of the plug liner of FIG. 12.
Figure 15:
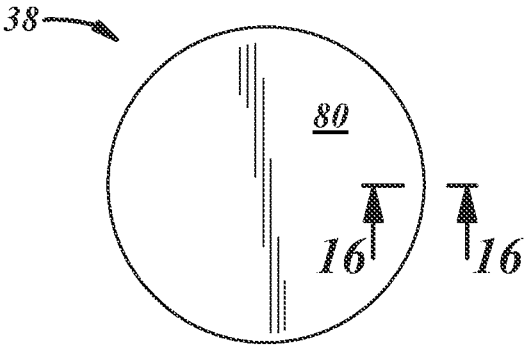
FIG. 15 is a diminished top view of the plug liner of FIG. 12.
Figure 16:
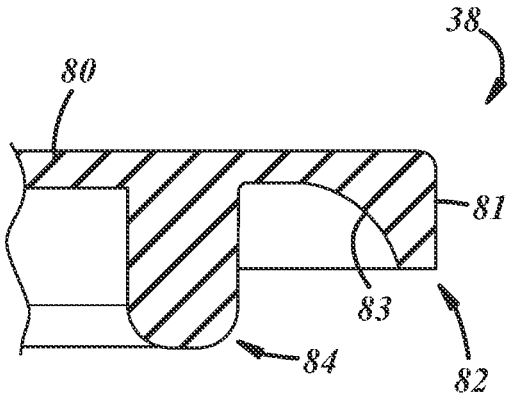
FIG. 16 is an enlarged cross-sectional view of a portion of the plug liner of FIG. 12, taken along line 16-16 of FIG. 15.
Figure 17:
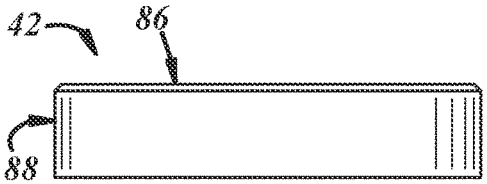
FIG. 17 is an elevational view of an illustrative embodiment of an outer shell of the closure assembly of FIG. 1.

With reference to FIG. 9, the outer skirt 46 includes an axially outward portion 52 extending in an axially outward direction away from the base wall 44, and an axially inward portion 54 extending in an axially inward direction away from the base wall 44 and terminating in an axially inward grip petal portion 56. The grip petal portion 56 includes a plurality of circumferentially spaced beads or petals 58 for gripping a corresponding portion of the container 12 (FIG. 1). The petals 58 are angularly or circumferentially spaced from one another, are circumferentially adjacent to one another with circumferential spaces 57 (FIGS. 6-8) therebetween, and extend axially and radially outwardly in a free state of the inner shell 40. The petals 58 may include two or more petals, for example, four, six, eight, ten, twelve petals, or any other suitable quantity of petals.

With continued reference to FIG. 9, the petals 58 may include radially thinned walls 59 extending downwardly from a lower end of the axially inward portion 54 of the outer skirt 46 to facilitate flexure of the petals 58. The petals 58 include radially inwardly projecting container engagement lugs 60 and radially outwardly projecting outer shell engagement lugs 62. The container engagement lugs 60 may include radially inwardly facing surfaces 64 that may be disposed at an oblique angle with respect to a radially inner surface 66 of the axially inward portion 54 of the skirt 46, and inner tapered undersurfaces or shoulders 65 extending between the surfaces 64, 66. The outer shell engagement lugs 62 may include radially outwardly facing surfaces 68, tapered sidewalls 70, and tapered outer surfaces 69 for engagement with the outer shell 42 (FIG. 1), as will be described in further detail below. The shell 40 may be molded so that the petals 58 extend axially and radially outwardly from the annular skirt 46 in a rest or free state, for example, as shown in FIG. 9. Accordingly, the petals 58 may be flexible and may have memory in that they tend to resiliently return radially outwardly toward their molded rest state.

Figure 10:
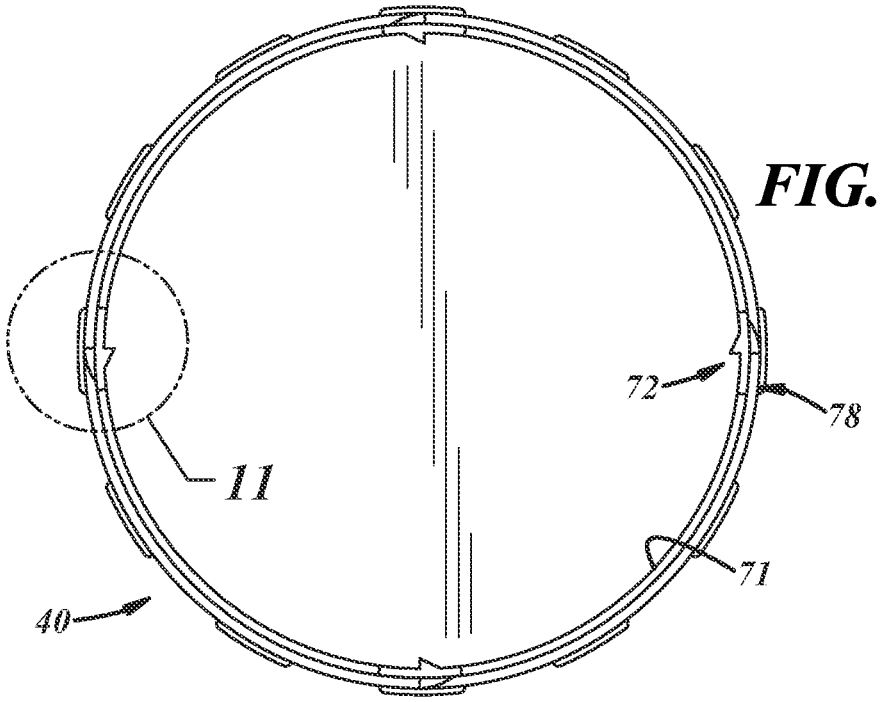
FIG. 10 is an enlarged top view of the inner shell of FIG. 6.

With reference to FIG. 10, the base wall 44 of the inner shell 40 may be radially continuous, such that the base wall 44 has no aperture or passage therethrough, and/or no portion of the outer shell 42 (FIG. 1) extends through the base wall 44. The axially outward portion 52 of the inner shell 40 may include a plurality of inner ramped stop lugs 72 projecting in a radially inward direction from a radially inner surface 71 of the axially outward portion 52. The ramped stop lugs 72 may be equidistantly spaced about an inner circumference of the axially outward portion 52 of the annular skirt 46.

Figure 11:
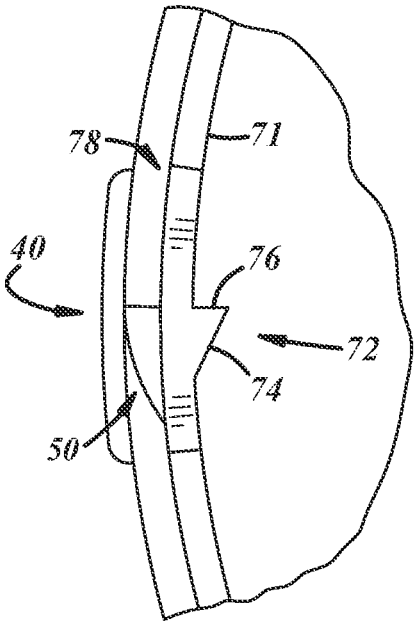
FIG. 11 is a further enlarged top view of a portion of the inner shell of FIG. 6, taken from circle 11 of FIG. 10.

With reference to FIG. 11, the lugs 72 may include ramped surfaces or cams 74 that may extend tangentially or chordally, and abutment surfaces or stops 76 that may extend radially. Also, the thread starts of the thread segments 50 are circumferentially aligned with respect to the abutment surfaces 76 of the stop lugs 72 within plus or minus 10 angular degrees. In the illustrated embodiment, the thread starts are circumferentially aligned with respect to the abutment surfaces 76 at 0 angular degrees. Moreover, the stop lugs 72 axially overlap the thread segments 50.

With reference to FIGS. 8 and 9, the axially outward portion 52 of the inner shell 40 also may include axially extending projections 78 angularly or circumferentially spaced around the inner shell 40 for limited, and not fully circumferentially continuous, contact with the outer shell 42 (FIG. 1). The projections 78 serve as standoffs on top of the inner shell 40 to reduce friction between the inner and outer shells 40, 42 when removing the closure 14 from the container 12 to open the package 10 (FIG. 1).

With reference to FIGS. 12 through 16, the plug liner 38 may be composed of an elastomeric type of polymeric material, for instance, a thermoplastic elastomer, rubber, plastisol, or the like. In any case, the plug liner 38 includes a base wall 80 that may be radially continuous, a radially outer skirt seal 82 extending away from an outer periphery of the base wall 80, and a radially inner plug seal 84 extending away from the base wall 80 and spaced radially inwardly from the skirt seal 82 and extending axially beyond the skirt seal 82. The skirt seal 82 has a cylindrical outer surface 81 and an incurvate inner surface 83. The plug liner 38 may be produced separately from the inner shell 40 (FIG. 1) and later assembled and adhered thereto, or may be molded to the inner shell 40 (FIG. 1). In the latter case, the plug liner 38 may be overmolded (or insert molded) or co-molded (or co-injection molded) to the inner shell 40, or molded according to any other suitable molding method(s). If co-molding, over-molding, or like methods are used, it is generally desirable that the polymer used to form the plug liner 38 be compatible with, and perhaps capable of adhering to, a polymer used to form the inner shell 40. In such cases, the plug liner 38 is not intended to be removed from the inner shell 40 without damage and is intended to remain durable for the lifetime of the inner closure 36.

With reference generally to FIGS. 17 through 21, the outer shell 42 includes a base wall 86, an annular outer skirt 88 extending axially away from the base wall 86, and an annular inner skirt 90 extending axially from the base wall 86 radially inwardly of the outer skirt 88. The annular inner skirt 90 is configured for radial and/or circumferential engagement with the outer skirt 46 of the inner shell 40 when the closure 14 is applied to the container 12 (FIG. 1), as will be discussed in detail below. The inner skirt 90 includes a radially outer surface 91 with an outer diameter less than an inner diameter of a radially inner surface 87 of the outer skirt 88. The outer skirt 88 includes an internally threaded portion with one or more internal thread segments 89. In the illustrated embodiment, the outer shell 42 includes four thread segments 89 and four thread starts. The outer skirt 88 also includes an extension 92 extending away from the threaded portion below the thread segments 89. The extension 92 need not have threads, such that it is unthreaded.

Figure 19:
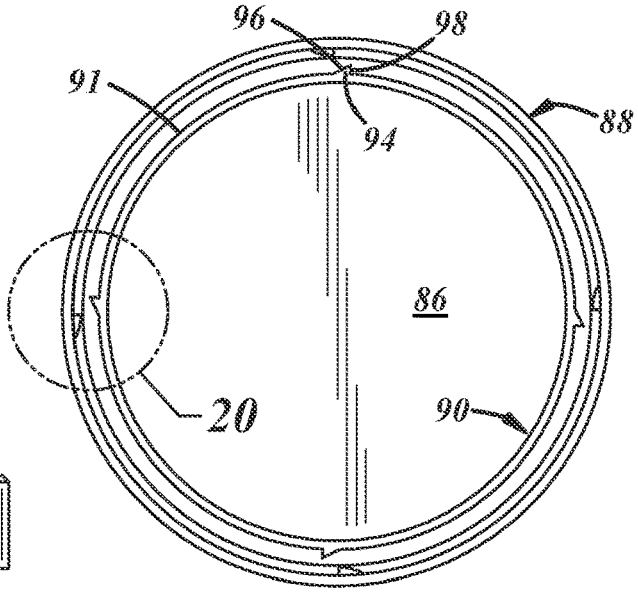
FIG. 19 is an enlarged bottom view of the outer shell of FIG. 17.
Figure 18:
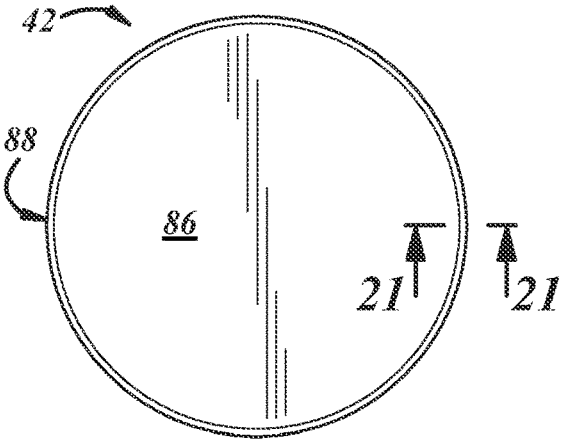
FIG. 18 is a top view of the outer shell of FIG. 17.
Figure 21:
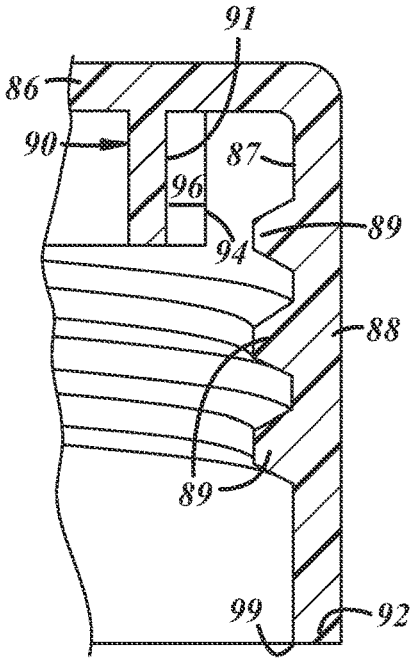
FIG. 21 is an enlarged cross-sectional view of a portion of the outer shell of FIG. 17, taken from line 21-21 of FIG. 18.
Figure 20:
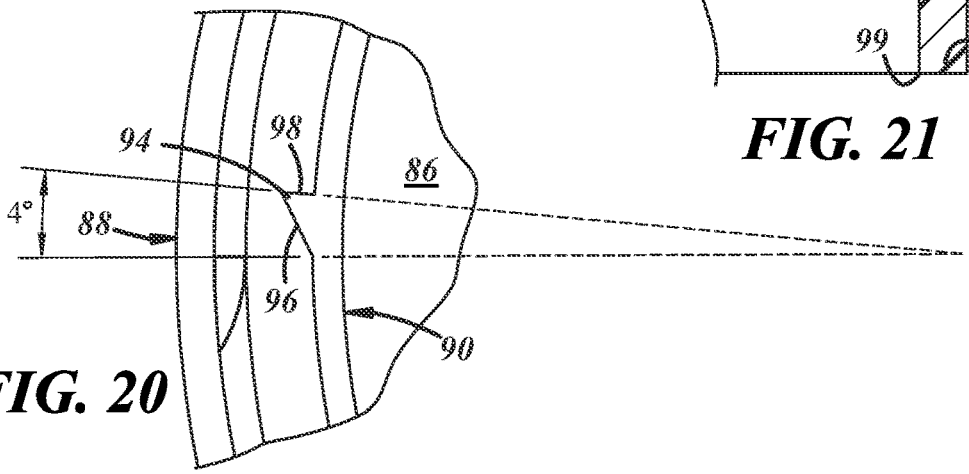
FIG. 20 is a further enlarged bottom view of a portion of the outer shell of FIG. 17, taken from circle 20 of FIG. 19.

With reference to FIGS. 19 through 21, the outer shell 42 also includes a plurality of outer ramped stop lugs 94 spaced about the circumference of the inner skirt 90 and projecting in a radially outward direction for cooperation with the plurality of ramped stop lugs 72 of the inner shell 40 (FIG. 11), as will be described in further detail below. The lugs 94 may include ramped surfaces or cams 96 that may extend tangentially or chordally, and abutment surfaces or stops 98 that may extend radially. Also, with reference to FIG. 20, the thread starts of the thread segments 89 are circumferentially aligned with respect to the abutment surface 98 of the stop lugs 94 within plus or minus 10 angular degrees. In the illustrated embodiment, the thread starts are circumferentially aligned with respect to the abutment surfaces 98 at 4 angular degrees. Accordingly, there is a circumferential offset in thread start to stop lug alignment between the inner and outer shells 40, 42 of about 4 degrees. In one example, the offset may be in a range between 2 and 8 degrees, including all ranges, subranges, and endpoints of that range. Moreover, the stop lugs 94 axially overlap the thread segments 89. As will be described in further detail below with respect to FIG. 26, the outer skirt 88 includes an axially lower edge 99 to engage the petals 58 of the inner shell 40 and fold or hook the petals 58 over the container neck external bead 24 when the closure 14 is being applied to the container 12 such that the outer shell 42 is being tightened to the inner shell 40.

Figure 22:
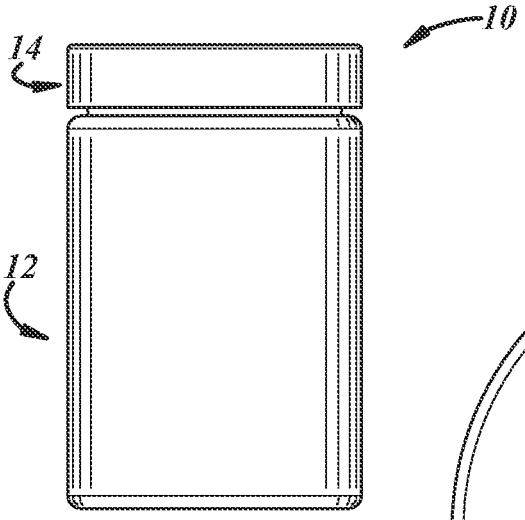
FIG. 22 is a diminished elevational view of the package of FIG. 1 in an assembled state.
Figure 23:
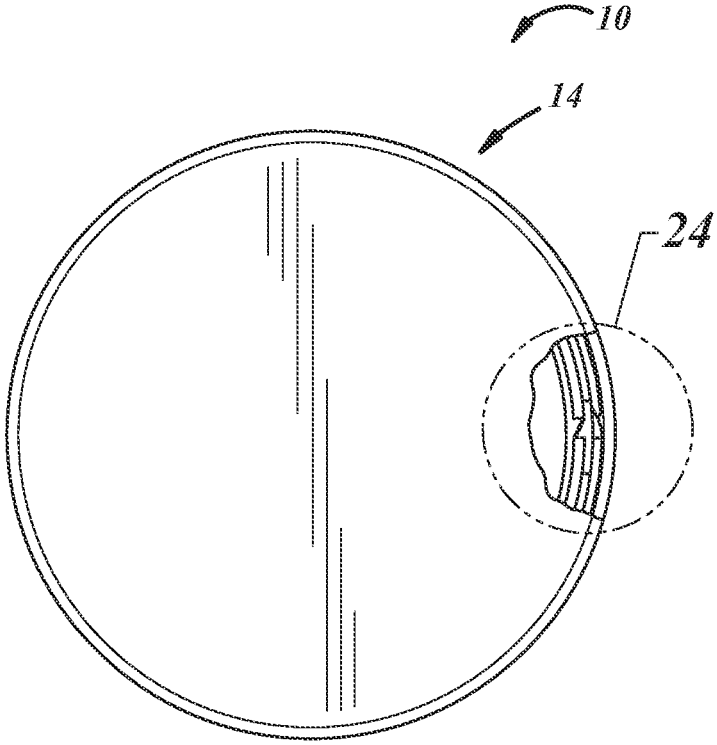
FIG. 23 is an enlarged, fragmentary, top view of the package shown in FIG. 22.
Figure 24:
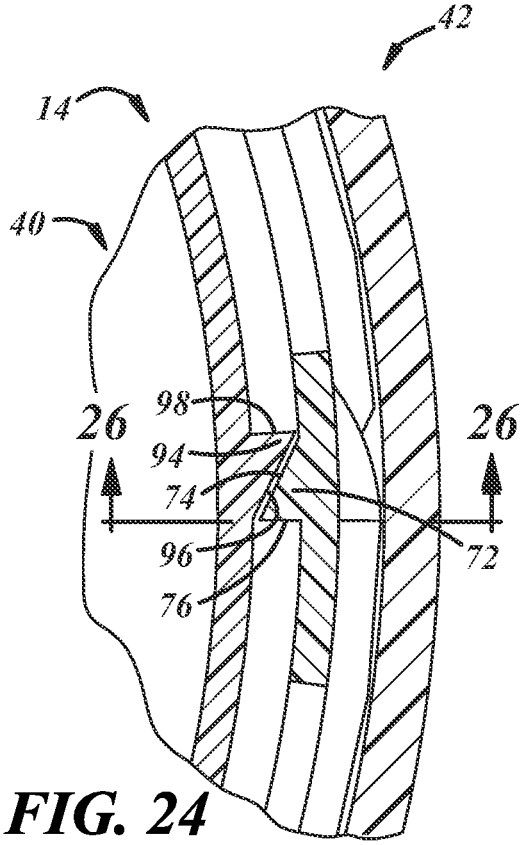
FIG. 24 is an enlarged cross-sectional view of a portion of the package shown in FIG. 22, taken from circle 24 of FIG. 23.
Figure 25:
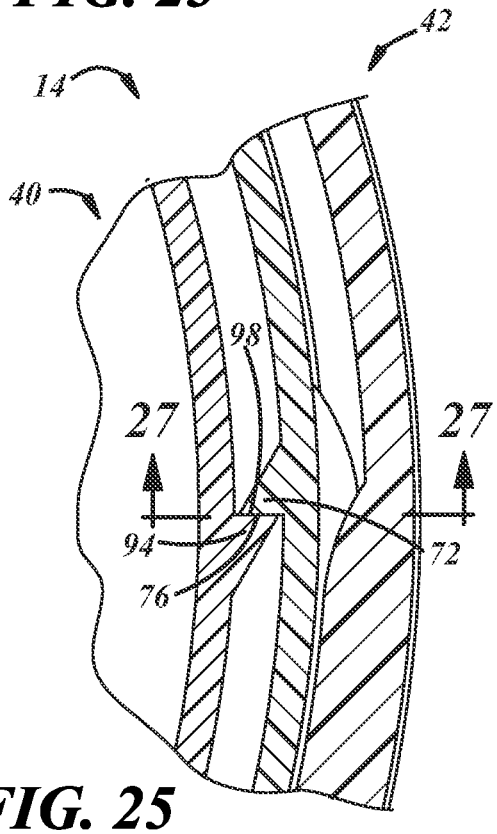
FIG. 25 is an enlarged cross-sectional view of the portion of the package shown in FIG. 24, wherein the inner and outer shells have been rotated with respect to one another.

In use, and with reference to FIG. 22, the closure 14 may be assembled or preassembled, and then applied to the container 12. First, the outer shell 42 may be threaded to the inner closure 36 to loosely assemble the outer shell 42 to the inner closure 36. As the outer shell 42 is initially threaded to the inner closure 36, the corresponding stop lugs 72, 94 are initially axially spaced apart. But, with reference to FIGS. 24 and 27, as the outer shell 42 is further threaded to the inner shell 40, eventually the corresponding stop lugs 72, 94 axially overlap and circumferentially override one another to allow the closure 14 to be preassembled. And, thereafter, with reference to FIG. 25, if the outer shell 42 is unthreaded from the inner shell 40, then the corresponding stops 76, 98 of the corresponding stop lugs 72, 94 will engage one another to keep the shells 40, 42 together and thereby prevent the closure 14 from coming apart absent some deformation or damage to the closure 14.

Figure 27:
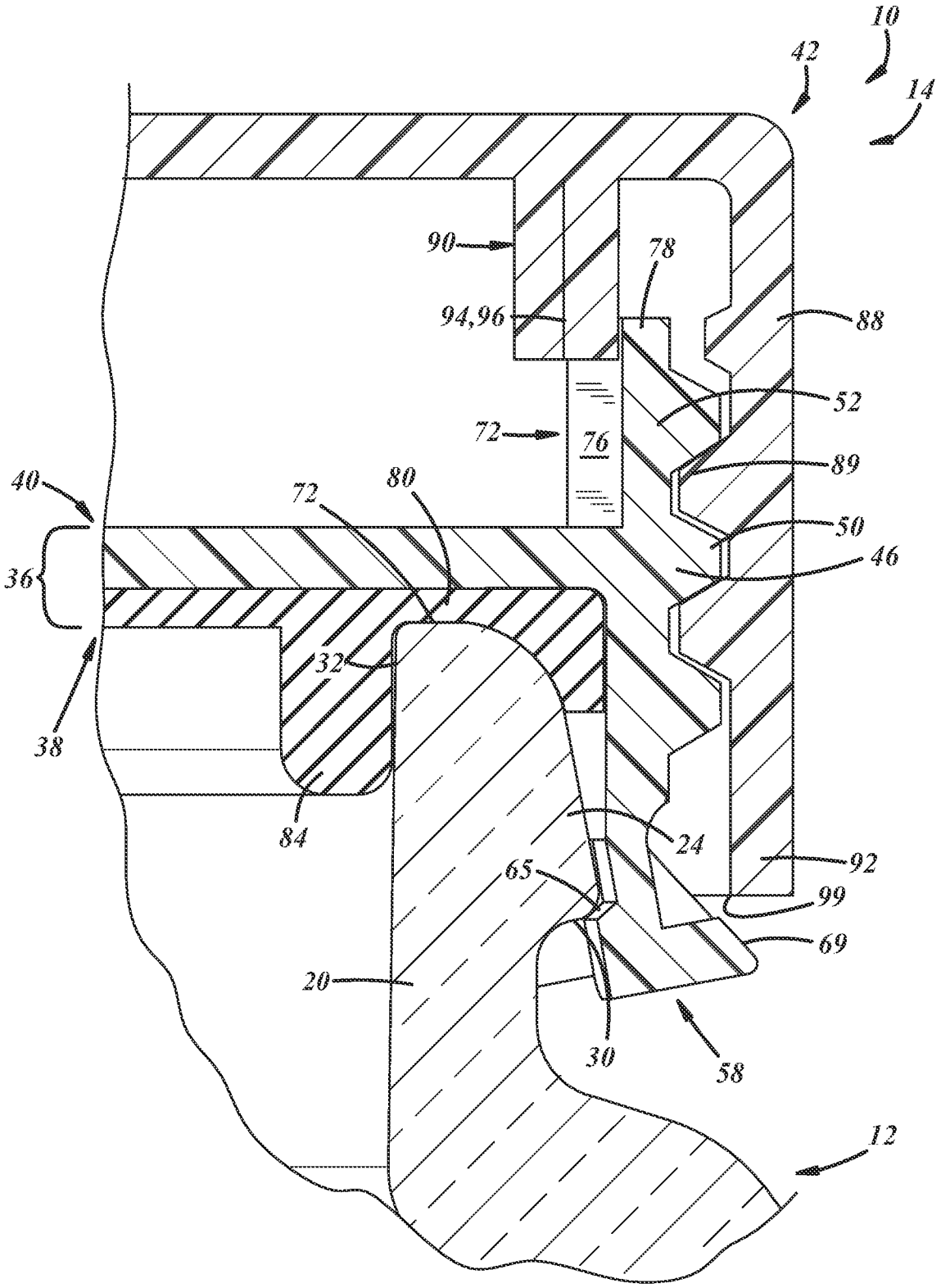
FIG. 27 is an enlarged cross-sectional view of the portion of the package shown in FIG. 25, taken along line 27-27 of FIG. 25, wherein the closure is shown being removed from the container.

Then, with reference to FIG. 27, the preassembled closure 14 may be located over the container neck 20 wherein the plug seal 84 of the plug liner 38 is inserted into the container neck 20 to seal to the container mouth 32, the base wall 80 of the plug liner 38 is engaged against the container neck lip 22 and bead 24, and the petals 58 are located around the container neck 20 and axially aligned with the undersurface or shoulder 30 of the neck bead 24. The plug liner 38 grips the container 12 to allow rotation of the outer shell 42 relative to the inner shell 40. Accordingly, the outer shell 42 may be additionally rotated relative to the inner closure 36 so that the internal thread segments 89 of the outer shell 42 additionally threadingly engage the external thread segments 50 of the inner shell 40.

Figure 26:
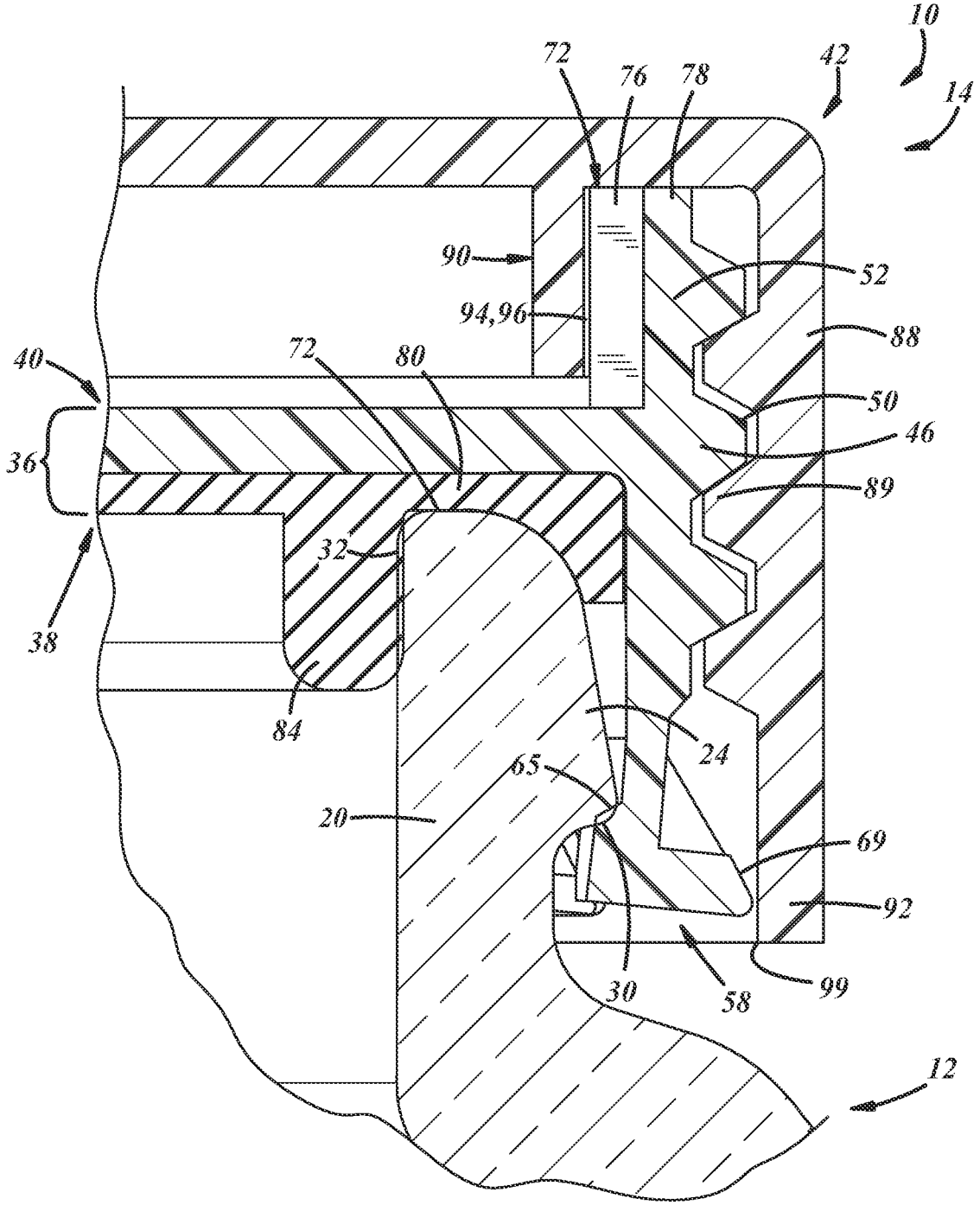
FIG. 26 is an enlarged cross-sectional view of a portion of the package shown in FIG. 22, taken along line 26-26 of FIG. 24.

Next, with reference to FIG. 26, rotation of the outer shell 42 continues such that the edge 99 of the unthreaded extension 92 of the annular outer skirt 88 of the outer shell 42 engages the tapered portions 69 of the petals 58 to fold or hook the petals 58 over the external bead 24 of the container neck 20, such that the corresponding shoulders 30, 65 fully engage, upon finished threading of the outer shell 42 to the inner shell 40. More specifically, the skirt edge 99 may engage the tapered surfaces 69 of the petals 58 to gradually fold the petals 58 into engagement with the container bead 24. Accordingly, the closure 14 is fastened and sealed to the container 12, and stays on the container 12 even when contents in the container 12 are pressurized, for example, from carbonated beverages. More particularly, the outer shell 42 fastens to the inner shell 40 to cause fastening of the inner shell 40 to the container 12 while the plug liner 38 of the inner closure 36 seals to the container 12.

Also, in use, and with reference to FIG. 27, the closure 14 may be removed from the container 12. As the outer shell 42 is unscrewed from the inner shell 40, the outer shell 42 moves axially relative to the container 12 but the inner shell 40 initially remains axially stationary with respect to the container 12. Again, the plug liner 38 grips the container 12 to prevent the inner skirt 40 from rotating relative to the container 12 as the outer shell 42 is unscrewed from the inner shell 40. Accordingly, the outer shell 42 may be rotated to partially disengage the internal thread segments 89 of the outer shell 42 from the external thread segments 50 of the inner shell 40. In this regard, the closure 14 of the illustrated embodiment is configured for 180 angular degrees of threaded engagement when the closure 14 is fully applied to the container 12, while maintaining 90 angular degrees of threaded engagement when the corresponding stops 76, 98 of the cooperating stop lugs 72, 94 engage one another.

Again, with continued reference to FIG. 27, the standoff projections 78 between the shells 40, 42 serve to provide reduced friction, compared to a configuration where the axially outward portion 52 of the skirt 46 would circumferentially continuously engage a corresponding portion of the outer shell 42. In this regard, the axial outward portion 52 of the inner shell 40 is longer than the inner skirt 90 of the outer shell 42. More specifically, the distance between the base wall 44 of the inner shell 40 and the end of the axial outward portion 52 of the inner shell 40 is greater than the distance between the base wall 86 of the outer shell 42 and the end of the inner skirt 90 of the outer shell 42.

As the outer shell 42 continues to be unscrewed from the inner skirt 40, the outer skirt 88 of the outer shell 42 moves away from the petals 58 to allow the resilient petals 58 to resiliently unfold in a direction toward their free state in which they extend axially and radially outwardly from the annular skirt 46 of the inner shell 40 and thereby at least partially release from the container 12. At this point, the corresponding stops 76, 98 of the stop lugs 72, 94 engage each other to prevent the closure 14 from being completely unthreaded and disassembled. Accordingly, the closure 14 can be pulled away from the container 12, wherein a pulling force exerted on the outer shell 42 causes the inner closure 36 to be pulled away from the container 12 by way of the threaded coupling between the outer shell 42 and the inner shell 40. Thereafter, the closure 14 may be reapplied and resealed to the container 12. Accordingly, the package 10 includes a container neck 20 without threads and without a closure circumferential orientation feature, and includes a closure 14 that operates in a familiar screw-on, screw-off manner, and that is resealable/reusable, and has an improved closure shell retention configuration. And, unlike some prior package designs, the package 10 may not require vents or venting to remove the closure 14, such that the closure 14 may be ventless.

The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A multi-piece container closure assembly, comprising:
an inner closure, including
an inner shell, having
a base wall, and
an inner shell outer skirt extending away from an outer periphery of the base wall, carrying external thread segments, and including an axially outward portion extending in a direction axially outwardly away from the base wall, and an axially inward portion extending in a direction axially inwardly away from the base wall and terminating in a grip petal portion having a plurality of circumferentially spaced petals having radially inwardly projecting container engagement lugs, and
a plug liner carried by the inner shell; and
an outer shell, including
a base wall,
an inner skirt extending away from the base wall, and
an outer shell outer skirt extending away from an outer periphery of the base wall at a location spaced radially outwardly from the inner skirt, and including an internally threaded portion carrying internal thread segments and an unthreaded extension extending away from the threaded portion and on an axial side of the internally threaded portion opposite that of the base wall,
wherein the plurality of circumferentially spaced petals also have radially outwardly projecting outer shell engagement lugs that include radially tapered outer surfaces for engagement with the outer shell.

2. The closure assembly of claim 1, wherein the base wall of the inner closure is radially continuous.

3. The closure assembly of claim 1, wherein the base wall of the outer shell is radially continuous.

4. The closure assembly of claim 1, wherein the axially outward portion of the inner shell outer skirt also includes a plurality of inner ramped stop lugs projecting in a radially inward direction, and wherein the outer shell also includes a corresponding plurality of outer ramped stop lugs spaced about the circumference of the inner skirt and projecting in a radially outward direction for cooperation with the plurality of ramped stop lugs of the inner shell outer skirt.

5. The closure assembly of claim 4, wherein the inner and outer ramped stop lugs axially overlap the internal and external thread segments.

6. The closure assembly of claim 4, wherein the outer shell is threaded to the inner closure until the stop lugs ride over one another, after which point the outer shell cannot be removed from the inner closure without deformation or damage to the closure.

7. The closure assembly of claim 6, wherein the internal and external thread segments include four thread segments with four thread starts, and wherein the thread starts are circumferentially aligned with respect to the inner and outer stop lugs within plus or minus 10 angular degrees.

8. The closure assembly of claim 4, wherein the plurality of inner ramped stop lugs of the inner closure are spaced about an inner circumference of the axially outward portion.

9. The closure assembly of claim 1, wherein the plug liner includes a base wall, a radially outer skirt seal extending away from an outer periphery of the plug liner base wall, and a radially inner plug seal extending away from the base wall and spaced radially inwardly from the radially outer skirt seal.

10. The closure assembly of claim 9, wherein the plug seal is axially longer than the skirt seal.

11. The closure assembly of claim 1, wherein the plug liner is overmolded to the inner shell.

12. The closure assembly of claim 1, wherein the petals include radially thinned walls extending downwardly from a lower end of the axially inward portion of the inner shell outer skirt of the inner closure to facilitate flexure of the petals.

13. The closure assembly of claim 1, wherein the container engagement lugs include radially inwardly facing surfaces disposed at an oblique angle with respect to a radially inner surface of the axially inward portion of the inner shell outer skirt of the inner closure, and inner tapered shoulders extending between said surfaces.

14. A package, including:

a bottle including a beaded neck finish having an open mouth and a bead with an undersurface; and the closure assembly of claim 1, wherein, the container engagement lugs of the inner closure axially align with the undersurface of the bead of the beaded neck finish of the bottle and the plug liner seals the open mouth of the beaded neck finish, and the unthreaded extension of the outer shell engages the petals of the inner closure to force the petals into locking engagement with the undersurface of the bead of the beaded neck finish.

15. The closure assembly of claim 1, wherein the plug liner is composed of an elastomeric material.

16. A multi-piece container closure assembly, comprising:

an inner closure, including an inner shell, having a base wall, and an inner shell outer skirt extending away from an outer periphery of the base wall, carrying external thread segments, and including an axially outward portion extending in a direction axially outwardly away from the base wall, and an axially inward portion extending in a direction axially inwardly away from the base wall and terminating in a grip petal portion having a plurality of circumferentially spaced petals having radially inwardly projecting container engagement lugs, and a plug liner carried by the inner shell; and an outer shell, including a base wall, an inner skirt extending away from the base wall, and an outer shell outer skirt extending away from an outer periphery of the base wall at a location spaced radially outwardly from the inner skirt, and including an internally threaded portion carrying internal thread segments and an unthreaded extension extending away from the threaded portion and on an axial side of the internally threaded portion opposite that of the base wall, wherein the axially outward portion of the inner closure has an axially outwardly extending standoffs, such that the axial outward portion of the inner closure is longer than the inner skirt of the outer shell.

* * * * *